US005634455A

United States Patent [19]

Troncoso

[11] Patent Number: 5,634,455

[45] Date of Patent: Jun. 3, 1997

[54] ARCHERY ARROW REST

[76] Inventor: Freddie Troncoso, 16990 Wildwood Dr., Montrose, Colo. 81401

[21] Appl. No.: 579,858

[22] Filed: Dec. 26, 1995

[51] Int. Cl.[6] ..... F41A 9/00

[52] U.S. Cl. ..... 124/44.5; 124/24.1

[58] Field of Search ..... 124/44.5, 24.1, 124/44.1

[56] References Cited

U.S. PATENT DOCUMENTS

| | | | |
|---|---|---|---|
| 2,725,870 | 12/1955 | Pfeiffer | 124/44.5 |
| 2,743,716 | 5/1956 | Wendt | 124/24.1 X |
| 2,777,435 | 1/1957 | Brooks | 124/24.1 X |
| 3,292,607 | 12/1966 | Hoyt, Jr. | 124/24.1 X |
| 3,672,347 | 6/1972 | Allen | 124/44.5 |
| 3,918,428 | 11/1975 | Wilson et al. | 124/44.5 |
| 4,064,863 | 12/1977 | Helmick | 124/44.5 |
| 4,378,780 | 4/1983 | Izuta | 124/24.1 |
| 4,380,226 | 4/1983 | Saunders | 124/44.5 |
| 4,703,745 | 11/1987 | Hammond | 124/44.5 |
| 4,827,895 | 5/1989 | Troncoso, Jr. . | |
| 4,919,115 | 4/1990 | Miller | 124/41.1 X |
| 4,947,823 | 8/1990 | Larson | 124/24.1 X |
| 4,953,521 | 9/1990 | Troncoso et al. | 124/44.5 X |
| 5,042,450 | 8/1991 | Jacobson | 124/44.5 |
| 5,052,364 | 10/1991 | Martin et al. | 124/44.5 |
| 5,148,796 | 9/1992 | Simo | 124/24.1 X |
| 5,190,023 | 3/1993 | Sacco | 124/24.1 X |
| 5,341,789 | 8/1994 | Paglia | 124/24.1 X |
| 5,467,759 | 11/1995 | Troncoso . | |
| 5,503,136 | 4/1996 | Tone | 124/44.5 |

OTHER PUBLICATIONS

"Starflight Radial Stabilizer", arrow rest brochure.

*Primary Examiner*—Terry Lee Melius
*Assistant Examiner*—Thomas A. Beach
*Attorney, Agent, or Firm*—Donald E. Nist

[57] ABSTRACT

The archery arrow rest features a thin, relatively flat arrow shaft-supporting blade disposed horizontally but with its thin edges disposed vertically so that the shaft is supported by the upper knife edge of the blade. The blade is inflexible vertically but flexible and resilient horizontally so as to be easily moved out of the way by the arrow shaft and/or vanes during shooting of the arrow from the rest. Preferably, the blade has a concave side facing the sidewall of the archery bow window and flexes easily in that direction in response to to side pressure from an arrow during shooting but automatically returns to the unflexed position when side pressure is released. The blade resists flexing toward its convex side. Since the blade is arcuate, it resists more effectively vertical bending. The rest also includes a holder releasably connected to the rear end of the blade. The holder includes, for example, a forwardly and rearwardly extending mounting block for releasable attachment of its front end to the sidewall of the riser of an archery bow adjacent the arrow window of the bow. The rear end of the mounting block is preferably attached to a transverse crossbar which extends behind the riser to a point behind the arrow window. The holder may further include a rod connected to the rear end of the blade and passing back into connection with the crossbar. Preferably, the rod is moveable forwardly, rearwardly and transversely.

3 Claims, 2 Drawing Sheets

FIG. 1
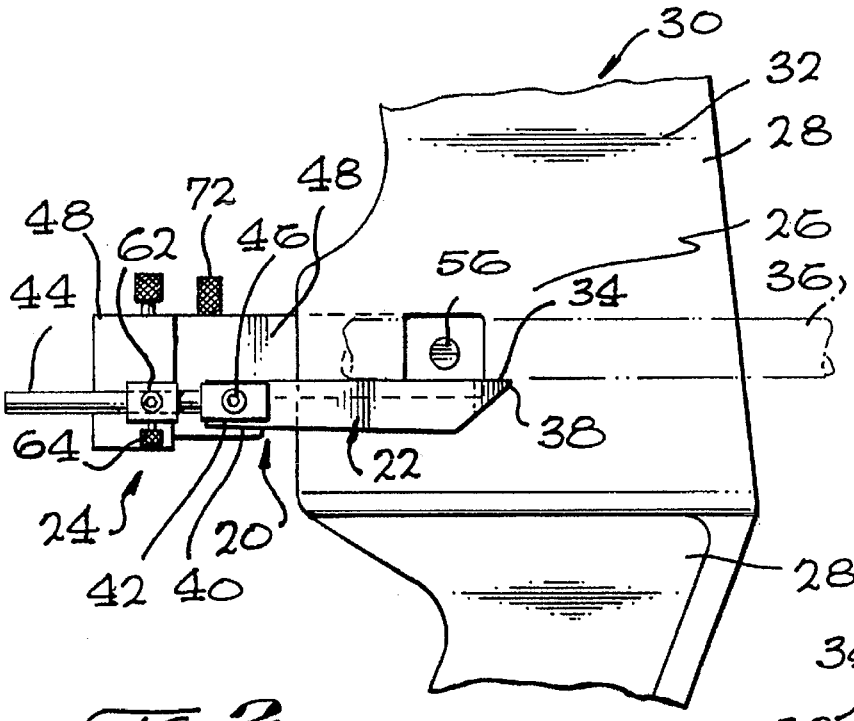
FIG. 2
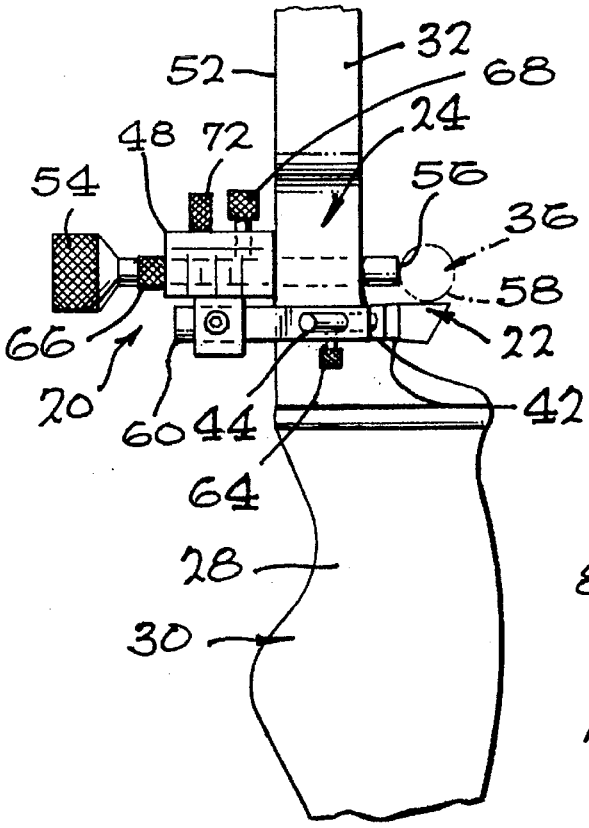
FIG. 3
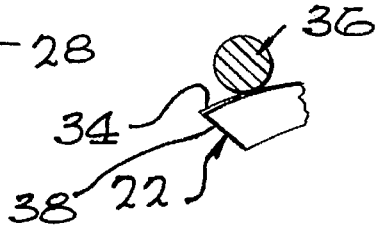
FIG. 4
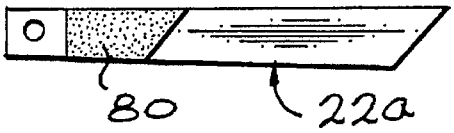
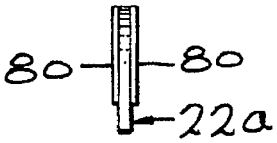
FIG. 5
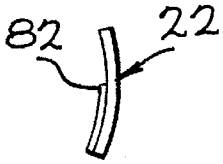
FIG. 6

FIG. 7
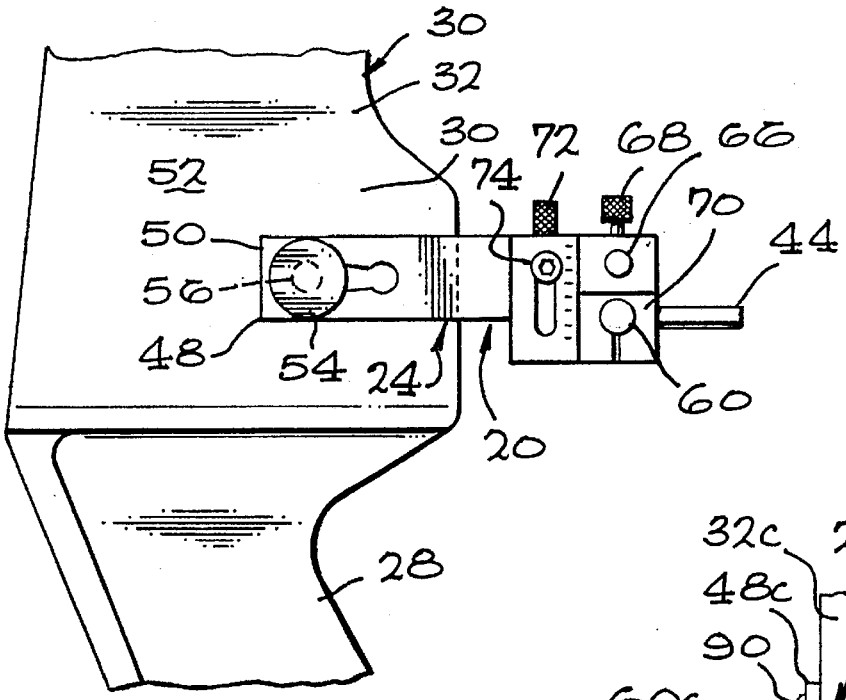
FIG. 9
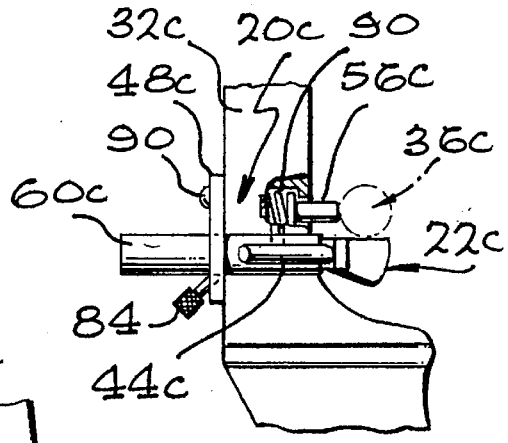
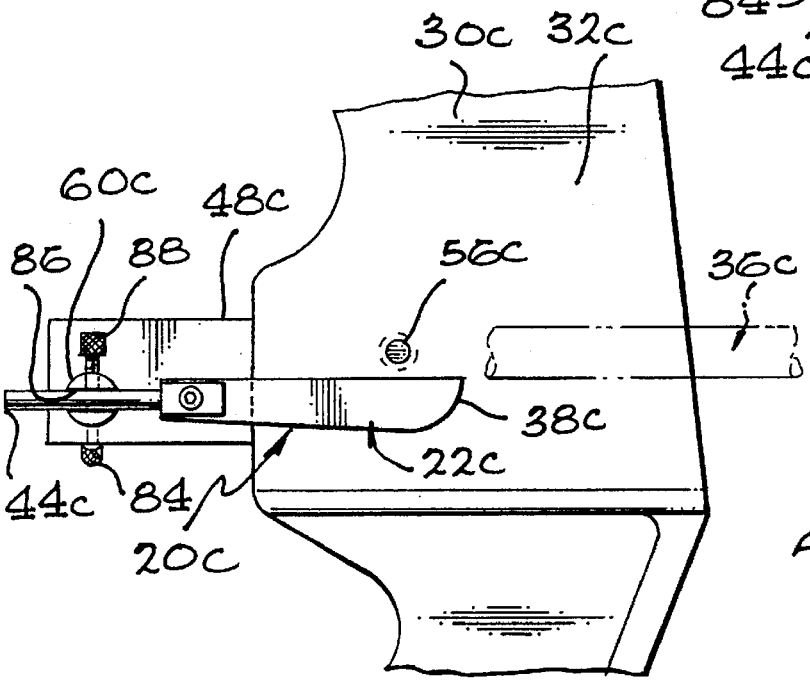
FIG. 8

ARCHERY ARROW REST

BACKGROUND OF THE INVENTION

1. Field of the Invention

The present invention generally relates to sports equipment and more particularly to an improved type of archery arrow rest.

2. Prior Art

Various types of archery arrow rests have been designed and utilized. Some of the older types of arrow rests comprised horizontal shelves attached to the sidewall of the riser portion of the archery bow and extending laterally into the arrow window in the riser. Difficulties have been encountered with such arrow rests because when an arrow is shot by the bow from the rest, the arrow is likely to strike the riser sidewall and/or rest, due to archer's paradox, that is, lateral serpentine bending of the arrow when shot, and to then fly off at an angle and not hit the target.

Certain newer arrow rests have attempted to solve the foregoing problem by cradling the opposite sides of the arrow shaft between two laterally spaced horizontally extending arrow rest arms projecting forward into the arrow window at a controlled distance from the riser sidewall. In order to partially absorb the downward thrust of the arrow shaft during shooting, such rests have generally been made flexible and resilient. Those rests which employ rigid arms instead of flexible ones still provide an obstacle to the arrow when shot and cause deflection of the arrow from its desired flight path.

A further difficulty has been encountered with flexible horizontal arrow rests due to the nature of the newest arrows. In order to increase the speed of the arrow and flatten its flight path for greater accuracy in shooting, light weight carbon fiber and graphite fiber arrows have been devised, with or without hollow metal cores, and having exceptionally front tips which are of metal to increase the stability and wearability of the arrows. Accordingly, such arrows have much of the arrow weight in the front portion of the arrow, due to the above. When such an arrow is drawn on a bow for shooting from a horizontal arrow rest which is vertically depressible, the further back the arrow is drawn, the less the rest sags. Accuracy therefore varies, depending on the exact point of release of the arrow, which may vary from shot to shot. This is particularly true when the shot must be made quickly, either due to a press of time during a tournament or due to the necessity of hitting an animal target quickly before it moves out of shooting range.

Accordingly, there remains a need for an improved archery arrow rest which is simple, durable, adjustable and which does not allow sagging during shooting. Moreover, such rest should not interfere with the flight of the arrow so that improved shooting accuracy can be maintained.

SUMMARY OF THE INVENTION

The improved archery arrow rest of the present invention satisfies all the foregoing needs. The rest is substantially as set forth in the ABSTRACT OF THE DISCLOSURE.

Thus, the arrow rest of the present invention comprises an elongated thin blade extending horizontally in a holder but with the opposite thin edges disposed vertically so that the arrow shaft sits on the upper thin edge of the blade. The blade is rigid vertically but flexes easily horizontally so that if it is struck by the arrow during shooting it easily flexes out of the arrow path and therefore does not interfere with shooting accuracy. Preferably, the blade is arcuate with the concave side facing the sidewall of the archery bow window so as to easily flex in that direction and automatically return to the unflexed position, due to elastic memory, after the arrow is shot from the window. Such a blade resists flexing in the convex direction. Alternatively, the blade can be of flat spring steel or the like. Its rear portion can be stiffened by a reinforcing element sheathing it, backing it or fronting it.

The rear portion of the blade is attached to a support rod or the like releasably connected to the holder. In a preferred embodiment, the holder includes an elongated mounting block, the front portion of which is releasably connected to the sidewall of the riser of the bow adjacent the arrow window. The rear portion of the block extends behind the riser and is intercepted by a crossbar which extends transversely behind the riser to a point behind the arrow window. The free end of the crossbar releasably secures the blade rod so that the blade extends forwardly into the arrow window along the longitudinal axis of the bow or at an angle thereto.

The blade is spaced from the sidewall of the riser a desired distance. For this purpose the crossbar can be transversely adjusted and releasably secured to the mounting block. Preferably, a side pressure point, most preferably a conventional cushion plunger or the like, can be mounted in the riser sidewall and extend laterally into the arrow window to contact the side of the arrow shaft as it sits on the top of the blade.

The described embodiment provides full adjustability of the arrow rest so that it can be utilized to fine tune the bow for optimal arrow flight. Since the rest does not sag during drawing of the arrow on the rest, the arrow aiming point does not vary during the draw, resulting in improved shooting accuracy.

Further features of the improved archery arrow rest of the present invention are set forth in the following detailed description and accompanying drawings.

DRAWINGS

FIG. 1 is a schematic side elevation of a first preferred embodiment of the improved archery arrow rest of the present invention, showing the rest extending into the arrow window on one side of the bow riser;

FIG. 2 is a schematic rear elevation of the arrow rest of FIG. 1 mounted on the bow of FIG. 1;

FIG. 3 is an enlarged fragmentary schematic front perspective view of the blade of FIG. 1, illustrating its arcuate shape;

FIG. 4 is a schematic side elevation of a second preferred embodiment of the blade of the arrow rest of the present invention;

FIG. 5 is an enlarged schematic front elevation of the blade of FIG. 4;

FIG. 6 is an enlarged schematic front elevation of a third preferred embodiment of the blade of the present invention;

FIG. 7 is a schematic side elevation of the arrow rest of FIG. 1, showing the side of the archery bow opposite that shown in FIG. 1;

FIG. 8 is a schematic side elevation of an alternative embodiment of the arrow rest of the present invention, showing the rest mounted in the arrow window of an archery bow; and, FIG. 9 is a schematic rear elevation, partly broken away, of the arrow rest of FIG. 8.

DETAILED DESCRIPTION

FIGS. 1–3 and 7.

A first preferred embodiment of the improved archery arrow rest of the present invention is schematically depicted in FIGS. 1–3 and 7. Thus, arrow rest 20 is shown, which comprises an elongated horizontally extending blade 22 releasably secured to a holder 24. Blade 22 is thin, arcuate with its opposite thin edges disposed vertically. It is mounted in the arrow window 26 in the riser portion 28 of an archery bow 30, spaced by holder 24 from the riser sidewall 32, so that its convex side faces sidewall 32. Preferably, blade 22 is of thin gauge, for example, 0.004–0.008 inch spring steel or the like, so that it is rigid vertically and does not sag under the weight of an arrow resting on its upper surface 34 but is flexible, resilient and with elastic memory horizontally so that it easily is moved out of the path of arrow 36 toward sidewall 32 when arrow 36 is shot from rest 20 if blade 22 is brushed by arrow 36, thereby not interfering with arrow 36 and its flight path, but automatically returns to the unflexed position when the flexing force is removed. Blade resists movement in the opposite direction, that is, towards its convex side. This results in improved shooting accuracy, as previously described. Blade 22 can be made of any suitable material or combination of materials, for example durable resilient plastic, spring steel or other flexible metal and can be of any suitable length and shape. For example, it can be about 1.5–2.5 inches in length and may have a pointed or rounded tip 38. Blade 22 is releasably secured at its rear end 40 to the front fitting 42 of a rearwardly extending rod 44, as by screw 46.

Holder 24 includes a forwardly and rearwardly extending elongated mounting block 48, the front portion 50 of which is releasably secured to the side 52 of sidewall 32 opposite that facing arrow window 26 (FIG. 7), as by a conventional spring plunger 54 extending tranversely through sidewall 32 so that the spring biased tip 56 of plunger 54 extends into arrow window 26 to contact the side of shaft 58 of arrow 36. Block 48 extends rearwardly to a point behind riser 28 where it receives a transverse crossbar 60.

Crossbar 60 slidingly receives the rear portion of rod 44. Thus rod 44 can be moved forwardly and rearwardly in window 26 and preferably is pivotably secured to crossbar 60 so that it can rotate in a horizontal plane to adjustably space blade 22 from plunger tip 56. Screws 62 and 64 releasably lock rod 44 to crossbar 60.

Crossbar 60 preferably is geared to block 48 so that it can be incrementally moved transversely by turning knob 66 and locked in place by screw 68. Crossbar 60 may be disposed in a bracket 70 geared to the rear end of mounting block 48 so that crossbar 60 can be raised and lowered by turning knob 72 and locked in place by screw 74.

As can be seen from FIGS. 1–3 and 7, blade 22 extends forward into arrow window 26 at an angle to the main axis of bow 30. This angle can be changed by rotating rod 44 in crossbar 60. If desired, blade 22 can be made to extend forwardly along the main axis of bow 30. It is preferred, however, to have blade 22 in the orientation shown in the drawings because this keeps rod 44 and crossbar 60 fully out of the flight path of arrow 36.

Holder 24 can be made of any suitable materials, such as aluminum, steel or the like for great durability and stability in use. Accordingly, arrow rest 20 has improved utility and characteristics.

FIGS. 4 and 5.

A modified version of the blade of the arrow rest of the present invention is schematically depicted in FIGS. 4 and 5. Thus, blade **22*a* is shown which differs from blade 22 only in that it employs a rear stiffening sheath 80 of metal, plastic or the like to improved the rigidity and durability of blade 22*a*. Moreover, blade 22*a*** is flat rather than arcuate.

FIG. 6.

A further modification of the blade of the arrow rest of the present invention is schematically depicted in FIG. 6. Thus, blade **22*b* is shown, which is arcuate and which employs a rear stiffening plate 82**.

FIGS. 8 and 9.

Another embodiment of the improved arrow rest of the present invention is schematically depicted in FIGS. 8 and 9. Thus, arrow rest **20*c* is shown. Components thereof similar to those of arrow rest 20 bear the same numerals but are succeeded by the letter "c". Arrow rest 20*c* is a simplified version of the arrow rest of the present invention. Rest 20*c* differs from rest 20** as follows:

a) Rest **20*c* has no gearing to incrementally advance crossbar 60*c*. Instead, crossbar 60*c* is slideably received through mounting block 48*c* and releasably locked by screw 84**.

b) Block **48*c* has no gearing to raise and lower crossbar 60*c***.

c) Rod **44*c* is releasably held in a slot 86 in the end of crossbar 60*c*, can be pivoted therein and locked by screw 88**.

d) Blade **22*c* is flat with a round front tip 38*c***. It flexes in both horizontal directions, with elastic memory.

e) Mounting block **48*c* is secured to sidewall 32*c* by a screw and there is no plunger, but instead, a side pin 56*c* biased by a spring 92 inset in sidewall 32*c***.

Rest **20*c* has the other advantages of rest 20**. Various other modifications, changes, alterations and additions can be made in the improved arrow rest of the present invention, its components and their parameters. All such moficiations, changes, alterations and additions as are within the scope of the appended claims form part of the present invention.

What is claimed is:

1. An improved archery arrow rest, said rest comprising, in combination:

a) an elongated thin blade comprising at least one of metal and plastic and extending horizontally but with opposite upper and lower thin edges aligned vertically to support an arrow shaft on said upper edge, said blade being rigid vertically and flexible horizontally, said blade having a front portion and a rear portion, said blade being arcuate when viewed from an end thereof and having a concave side and an opposite convex side for improved vertical rigidity; and, b) a holder releasably connected to said rear portion of said blade, said holder including means for releasably connecting said rest to an archery bow having a riser and an arrow window defined by said riser, said releasable connection of said holder being to said sidewall of said riser for suspending said blade in said archery bow arrow window in an about horizontal plane, with said concave side of said blade facing said sidewall for flexing toward said sidewall in response to side pressure from an archery arrow when shot from said rest, said blade after said flexing automatically returning to the unflexed position due to elastic memory, said holder including an elongated mounting block, the front portion of which is connectable to said riser sidewall so that the block extends to the rear of said riser, and wherein said holder includes a crossbar connected to the rear end of said block and extending transversely behind said riser to a point behind said arrow window, wherein said crossbar is transversely adjustable and wherein said holder also includes a rod releasably connected to the rear portion of said blade and releasably held by said crossbar, whereby transverse movement of said crossbar adjusts the lateral position of said blade in said arrow window, said rod being slideable forwardly and rearwardly through said crossbar for adjusting the forward position of said blade in said arrow window.

2. The improved arrow rest of claim 1 wherein said rod projects forwardly into said arrow window at an angle from the longitudinal axis of said window and is mounted for adjustable rotation in an about horizontal plane, so as to be able to change the position of said front portion of said blade from said riser sidewall.

3. An improved archery arrow rest, said rest comprising, in combination:

a) an elongated thin blade of spring steel which has a front portion and an opposite rear portion and which slopes and narrows from said front portion rearwardly toward said rear portion, said blade extending horizontally but with opposite upper and lower thin edges aligned vertically to support an arrow shaft on said upper edge, said blade being rigid vertically and flexible horizontally; and, b) a holder releasably connected to said rear portion of said blade, said holder including means for releasably connecting said rest to an archery bow having a riser and an arrow window defined by said riser, said releasable connection of said holder being to said sidewall of said riser for suspending said blade in said arrow window in an about horizontal plane.

* * * * *